US005643656A

United States Patent [19]

Lin

[11] Patent Number: 5,643,656

[45] Date of Patent: Jul. 1, 1997

[54] PACKING CUSHION BOARD

[76] Inventor: Tso Nan Lin, 10F., No. 83, Shui-Yuan Rd.,, Taipei, Taiwan

[21] Appl. No.: 514,998

[22] Filed: Aug. 14, 1995

[51] Int. Cl.[6] ..... B32B 1/00

[52] U.S. Cl. ..... 428/174; 428/178; 428/192; 428/99; 108/51.1

[58] Field of Search ..... 428/178, 174, 428/99, 120, 180, 192; 108/51.1

[56] References Cited

U.S. PATENT DOCUMENTS

| | | | |
|---|---|---|---|
| 1,984,653 | 12/1934 | Palmer et al. | 428/178 |
| 3,013,641 | 12/1961 | Compton | 428/178 |
| 3,227,598 | 1/1966 | Robb | 428/178 |
| 3,479,779 | 11/1969 | Ziegler | 428/178 |
| 3,742,663 | 7/1973 | Duskin | 428/178 |
| 3,865,679 | 2/1975 | Hale | 428/178 |
| 3,876,492 | 4/1975 | Schott | 428/178 |
| 3,940,811 | 3/1976 | Tomikawa et al. | 428/178 |

*Primary Examiner*—Donald Loney
*Attorney, Agent, or Firm*—Pro-Techtor International

[57] ABSTRACT

The present invention is a packing cuahion board which has several protuberances in specific height and arrange in a matrix style to be a certain area board unit and each protuberance has a specific height and a top surface which extend a awl shape slope; on the slope there are several ridges and in the middle of the slope has a horizontal ridge to connect to each adjacent protuberance; moreover, every side of each protuberance form a gorge bottom surface and from the horizontal ridge extend a slope to the bottom surface has a stairstep on the middle of the extended slope; it combine four extended slope and the slope to form a separated gorge. Each unit of present invention can be stack up to reduce the storage room, and after used this product can be stored for future use or can be recycled. Each protuberance can support 4.4 lb. to 8.8 lb. pressure which is each square feet can support around 220 lb. pressure. Each square feet should have 36 protuberance. If each unit board can be connected to another unit board in order to enlarge the area and to stick on the surface of goods to protect goods from bumping. Or several unit boards can stack up to increase the thickness and support pressure, and it also can bend this board on the corner of goods which can fix the goods in the carton and prevent bumping. The present invention can add corrugate board or card board on the top or bottom of the unit board in order to fix some special goods. This is an environment protection product which has no pollution and can be used again and again. Those advantages are more superior than the conventional packing material.

3 Claims, 5 Drawing Sheets

PACKING CUSHION BOARD

BACKGROUND OF THE INVENTION

1. Field of the Invention

The present invention is a packing cushion board which is made from recycle pulp and formed an unit with several protuberances in specified height and arrange in matrix style. This is a special product for environment protection.

2. Description of the Prior Art

The conventional package uses polystyrene form as packing material, but polystyrene form causes the environment pollution. Most of developing countries already restrict to use polystyrene form. However, the general plastic packing material not only unpracticed, but also pollute the environment. The recycle movement is becoming popular, and the inventor of this product has many years experience on paper products, so he developed the present invention to replace polystyrene form and after a series testing in order to be a good packing material.

SUMMARY OF THE INVENTION

The purpose of present invention is to provide a packing cushion board which blend recycle paper to be recycle pulp and to form an unit with several protuberances in specified height and arrange in matrix style. This unit has a certain area as a board style packing material in order to replace current packing material which has no function for environment protection. Each unit of present invention can be stack up to reduce the storage room, and after used this product can be stored for future use or can be recycled. This is an environment protection product which has no pollution and can be used again and again. Those advantages are more superior than the conventional packing material.

The second purpose of the present invention is to provide a packing material as above mentioned. Each protuberance can support 4.4 lb. to 8.8 lb. pressure which is each square feet can support around 220 lb. pressure. Each square feet should have 36 protuberance. If each unit board can be connected to another unit board in order to enlarge the area and to stick on the surface of goods to protect goods from bumping. Or several unit boards can stack up to increase the thickness and support pressure, and it also can bend this board on the comer of goods which can fix the goods in the carton and prevent bumping.

The third purpose of the present invention is to add corrugate board or card board on the top or bottom of the unit board in order to fix some special goods.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
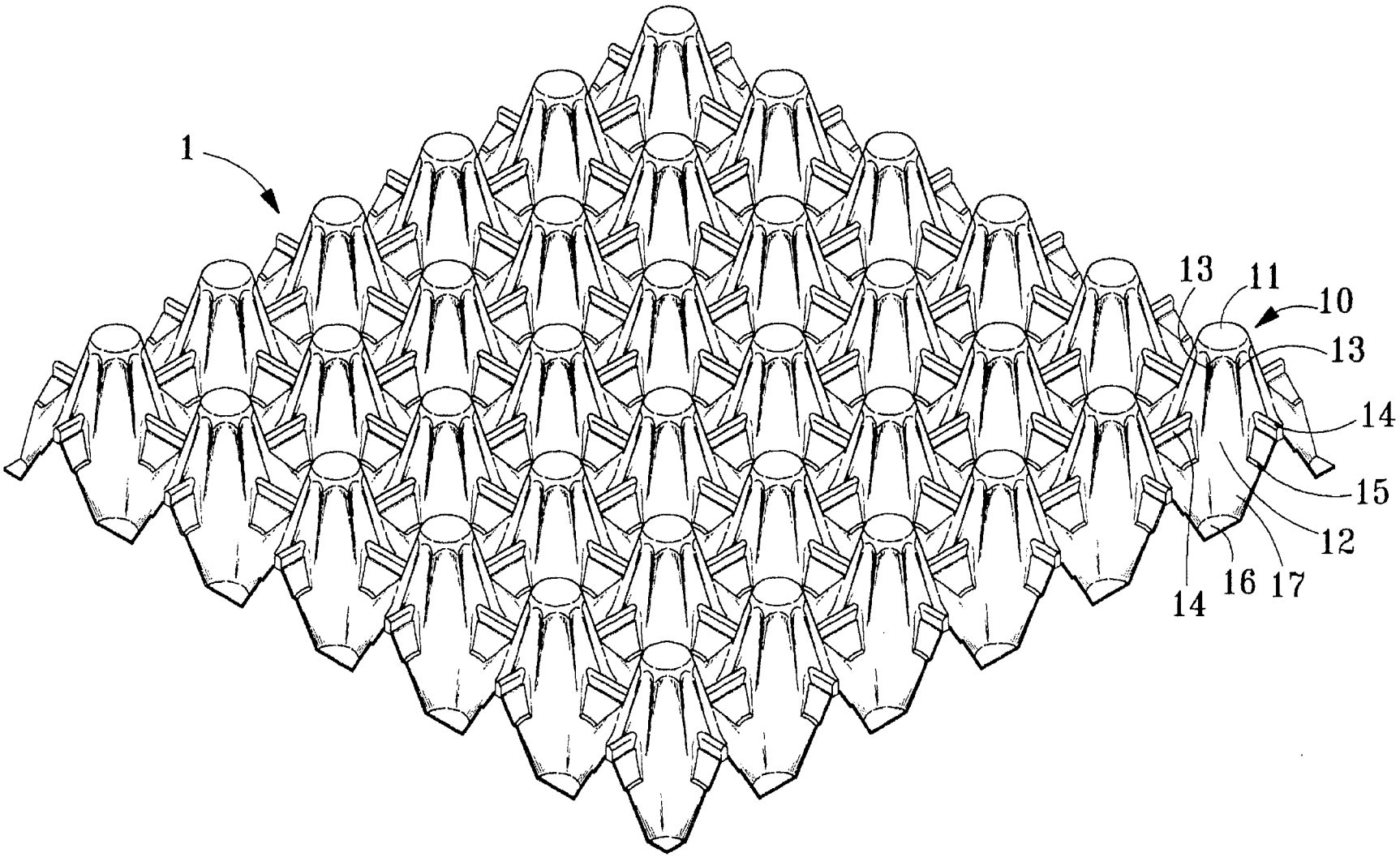
FIG. 1. is the perspective view of present invention.

As shown in FIG. 1 is packing cushion board of present invention which has several protuberances (10) in specific height and arrange in a matrix style to be a certain area board unit (1) as packing material in order to replace conventional non-environment-protection packing material. Each protuberance (10) has a specific height and a top surface (11). From the top surface (11) extend an awl shape slope (12), and on the slope (12) there are several ridges (13) to enhance the pressure support of upper portion of the slope (12), and also in the middle of the slope (12) has a horizontal ridge (14) to connect to each adjacent protuberance. Moreover, every side of each protuberance form a gorge bottom surface (16). From the horizontal ridge (14) extend a slope (17) to the bottom surface (16) and in a certain height on the slope (17) has a stairstep (15) to enhance the pressure support of lower portion of the slope (12) and combine four extended slope (17) and the slope (12) to form a separated gorge.

Figure 2:
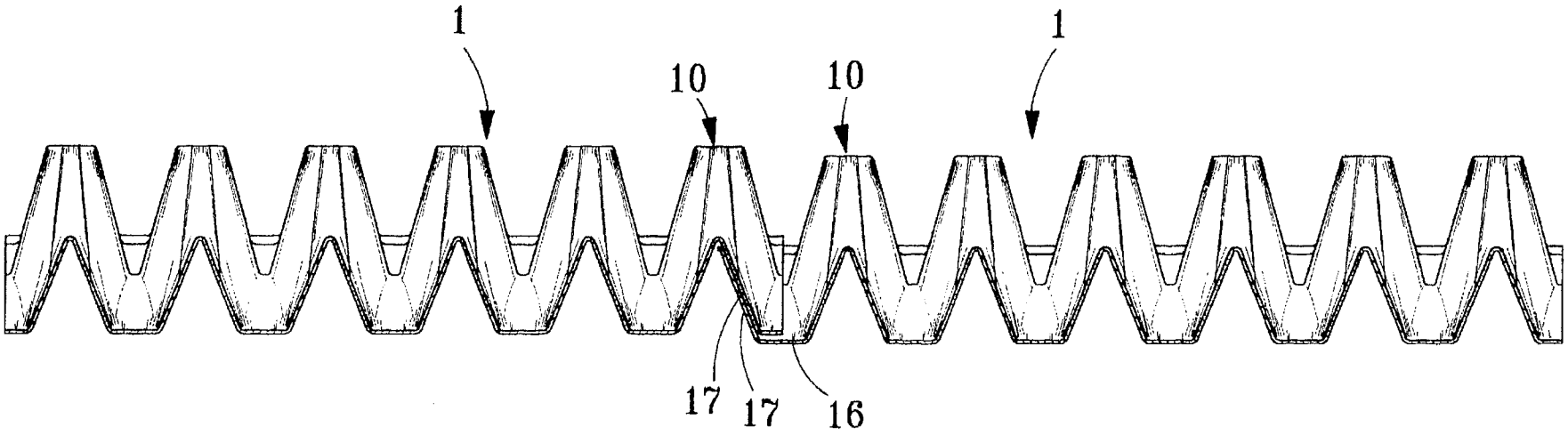
FIG. 2. is the explosion view of connection of two unit board of present invention.
Figure 3:
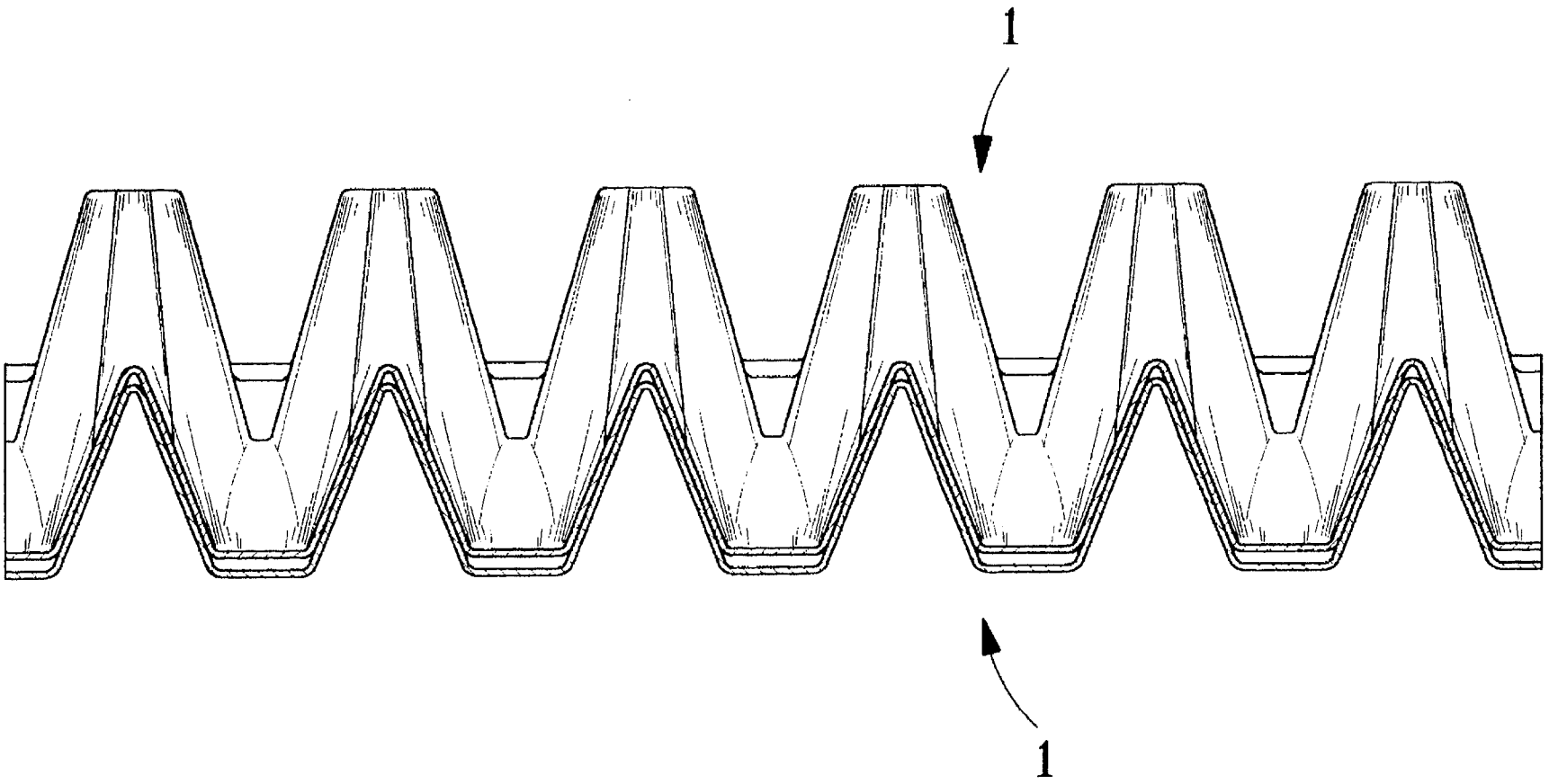
FIG. 3. is the explosion view of unit board storage of present invention.
Figure 4:
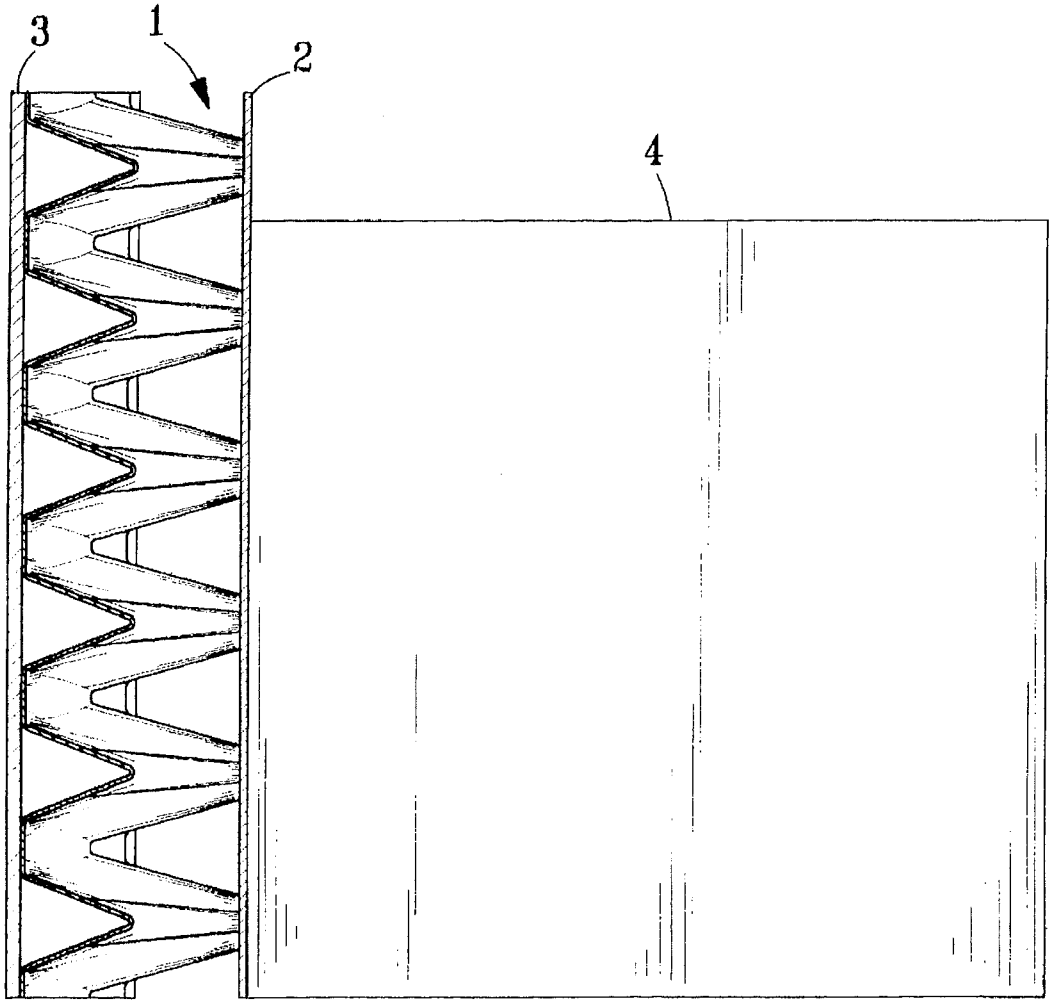
FIG. 4. is the explosion view that put goods to a unit board with card board.
Figure 5:
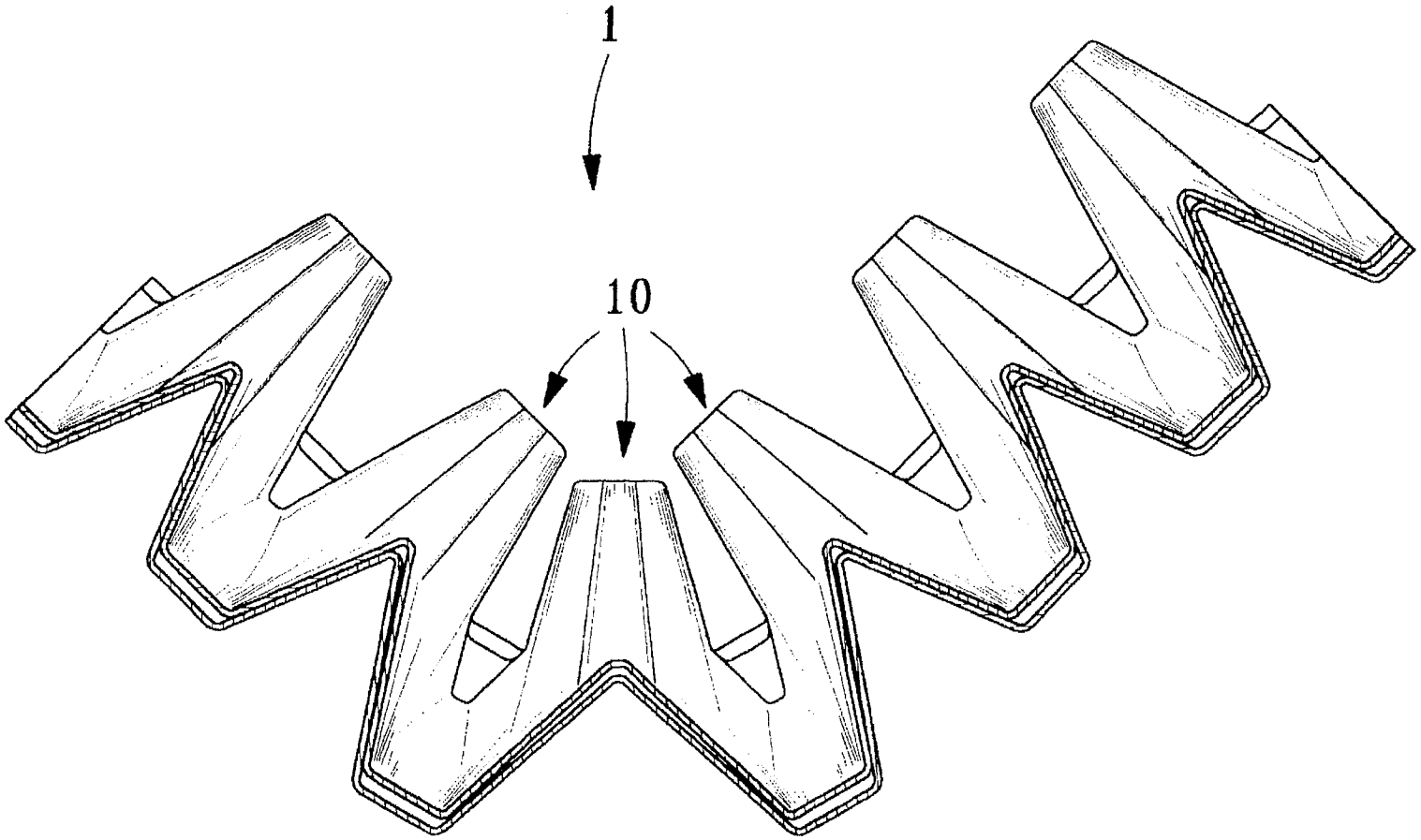
FIG. 5. is the explosion view of unit board bending of present invention.

Each protuberance (10) can support 4.4 lb. to 8.8 lb. pressure, in other words, each square feet at least can support around 220 lb. pressure. That is each square feet has 36 protuberance unit, but this is not an absolutely limitation, so the area of an unit board can be one or two square feet. The height of each unit is one inch or 1.5 inch or 2 inches and each side of the unit (1) can connect to adjacent unit (1) in order to form a larger area to steak on the surface of goods. The connection method is shown on FIG. 2 which is one side of the gorge to cover on to one side of ridge of another unit. If you want to adjust the length, it also can use one side of top ridge of one unit to the one side of top ridge of the other unit, thus two unit can connect together very tight. Thus, using one unit as base extend in all direction to make a large area. As shown in FIG. 3, each unit (1) can be stacked together for storage in order to save storage space which at least save three forth storage space than polystyrene form. Manufacturers and consumers have more space for storage. Besides, several unit stack together can form a thicker cushion board in order to enhance the pressure support. As FIG. 4, it can put a corrugate board or card board (2) on the top or bottom of unit (1) to have more surface touching to the surface of goods (4) or the surface of carton (3). Hence, the present invention can be use to fix some goods that need better protection or some irregular shape goods. As shown in FIG. 5, the unit board of present invention put on the corner of goods (4), and only bend the unit (4) in order to make the three protuberances touch each other on the corner, thus can fix the goods in the carton and prevent any bumping or collusion.

The present invention mainly uses blended recycle paper to form an unit. Of course, it can use virgin pulp which has better pressure support, but for environment protection consideration using recycle pulp is better.

The present invention also can be use as layer packing material; for large size goods, it can use several unit connecting together and bend on the corner. If the length is too long, the exceeded length can be cut off. Also it can put corrugate board between goods for better protection. The present invention is a resource recycling product for better environment protection.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A packing cushion board comprising:

a sheet of thin material that is sufficiently flexible so that it can be bent to form a curve of at least ninety degrees;

said sheet includes a plurality of protuberances deployed in a plurality of rows and columns to form a square lattice design, said protuberances are generally conical in shape, with a flattened upper surface, a base of said protuberances conjoins with bases of adjacent protuberances to increase strength of said sheet, each said protuberance includes four connecting members extending therefrom at ninety degree intervals, said connecting members link adjacent protuberances to further increase the strength of said sheet; wherein said protuberances are readily deformed and collapse to absorb any shock force that is applied to said sheet so that an object protected by said sheet is not damaged by said shock force.

2. The packing cushion board of claim 1 wherein:

a perimeter of said sheet includes an attaching means, said attaching means serving to join at least two of said sheets together so as to form a larger protected area.

3. The packing cushion board of claim 1 wherein:

said sheet is formed from recycled pulp.

* * * * *